US005934113A

United States Patent [19]

Loughlin

[11] Patent Number: 5,934,113

[45] Date of Patent: Aug. 10, 1999

[54] SECURITY DEVICE

[76] Inventor: Robert W. Loughlin, P.O. Box 129, Stanton, N.J. 08885

[21] Appl. No.: 09/109,944

[22] Filed: Jul. 6, 1998

Related U.S. Application Data

[62] Division of application No. 08/856,731, May 15, 1997, Pat. No. 5,845,519, which is a continuation of application No. 08/563,262, Nov. 27, 1995, abandoned, which is a continuation of application No. 08/181,842, Jan. 18, 1994, Pat. No. 5,524,462.

[51] Int. Cl.[6] ..... E05B 67/38; E05B 39/02

[52] U.S. Cl. ..... 70/50; 70/2; 292/286; 292/328; 292/329

[58] Field of Search ..... 70/1, 2, 14, 19, 70/20, 50, 18; 292/281, 282, 284, 286, 287, 328, 329, 330, 331

[56] References Cited

U.S. PATENT DOCUMENTS

| | | | |
|---|---|---|---|
| 1,243 | 7/1839 | Nock . | |
| 1,874 | 12/1840 | Williams . | |
| Re. 4,734 | 2/1872 | Lyon | 292/328 |
| 5,057 | 4/1847 | Chambers . | |
| 14,059 | 1/1856 | Harrison . | |
| 18,169 | 9/1857 | Yale . | |
| 31,003 | 12/1860 | Norton . | |
| 62,636 | 5/1867 | Kelly . | |
| 91,610 | 6/1869 | Crosby . | |
| 165,741 | 7/1875 | Lockwood . | |
| 418,359 | 12/1889 | Troast . | |
| 438,824 | 10/1890 | Price . | |
| 511,430 | 12/1893 | Hubert . | |
| 568,701 | 9/1896 | Roberts . | |
| 582,454 | 5/1897 | Carroll . | |
| 585,594 | 6/1897 | Roberts . | |
| 601,316 | 3/1898 | Dickson . | |
| 602,144 | 4/1898 | Roberts . | |
| 622,371 | 4/1899 | Kunze . | |
| 647,592 | 4/1900 | Wiseman . | |
| 683,286 | 9/1901 | Houser . | |
| 695,347 | 3/1902 | Soley . | |
| 865,313 | 9/1907 | Orbison et al. | 292/328 |
| 899,268 | 9/1908 | Soley . | |
| 1,049,380 | 1/1913 | Martineau | 292/328 |
| 1,081,710 | 12/1913 | Wisbman . | |
| 1,136,735 | 4/1915 | Taylor . | |
| 1,149,022 | 8/1915 | Burgess . | |

(List continued on next page.)

FOREIGN PATENT DOCUMENTS

| | | | |
|---|---|---|---|
| 624880 | 7/1927 | France | 70/58 |
| 519 | of 1890 | United Kingdom | 70/50 |
| 5326 | of 1898 | United Kingdom | 70/50 |

OTHER PUBLICATIONS

Disclosure to American Lock Company Jun. 8, 1990.

Commercial Literature: Safety Lockout—Master Lock Co. Safety Lockout—American Lock Co Key Ring (Le Clasp)—TSAMAS.

*Primary Examiner*—Darnell M. Boucher
*Attorney, Agent, or Firm*—Lerner, David, Littenberg, Krumholz & Mentlik, LLP

[57] ABSTRACT

A padlock concept consisting of a novel shackle comprised of two tapered shackle elements arranged so that they overlay each other to enclose and opening sufficient to accept the staple of a hasp or attachment device. The shackle elements are connected at one end and when unlocked and unlatched are free to move apart, in a motion causing the two shackle elements to separate, providing a clearance between them, at the unconnected end. Each shackle element includes an opening to allow the staple of the hasp to pass to the common opening. This clearance occurs in opposing elements so that when the elements are brought together or closed the staple of the hasp is completely enclosed by the two shackle elements which substantially fill the space available within the hasp staple. The elements are then latched and locked to provide the security function of a padlock engaged with the staple of a hasp or attachment device.

3 Claims, 7 Drawing Sheets

U.S. PATENT DOCUMENTS

| | | | |
|---|---|---|---|
| 1,167,377 | 1/1916 | Brown . | |
| 1,439,111 | 12/1922 | Laney | 70/203 |
| 1,445,648 | 2/1923 | Squires . | |
| 1,463,230 | 7/1923 | Squires . | |
| 1,875,400 | 9/1932 | Wood | 24/598.2 |
| 1,903,885 | 4/1933 | Trewhella . | |
| 1,949,402 | 3/1934 | Beaver | 70/104 |
| 2,931,676 | 4/1960 | Wroughton . | |
| 3,827,266 | 8/1974 | Walters | 70/104 |
| 4,095,872 | 6/1978 | Stieff et al. | 350/96.24 |
| 4,195,503 | 4/1980 | Roberts | 70/366 |
| 4,353,583 | 10/1982 | Moberg | 292/320 |
| 4,431,220 | 2/1984 | Loughlin | 292/340 |
| 4,688,405 | 8/1987 | Epstein | 70/14 |
| 4,689,975 | 9/1987 | Dunphy | 70/56 |
| 4,835,996 | 6/1989 | Loughlin | 70/53 |
| 4,885,919 | 12/1989 | Loughlin | 70/34 |
| 4,891,961 | 1/1990 | Tsamas | 70/456 |
| 5,146,771 | 9/1992 | Loughlin | 70/56 |
| 5,174,135 | 12/1992 | Louglin | 70/2 |
| 5,582,042 | 12/1996 | Mordick | 70/19 |

SECURITY DEVICE

This is a divisional application of U.S. Ser. No. 08/856,731 filed on May 15, 1997, now U.S. Pat. No. 5,845,519, which is a continuation of U.S. Ser. No. 08/563,262 filed Nov. 27, 1995, now abandoned, which is a continuation of U.S. Ser. No. 08/181,842 filed on Jan. 18, 1994, now U.S. Pat. No. 5,524,462.

BACKGROUND—THE INVENTION

This invention relates to conventional shackle padlocks, specifically to an improved two piece shackle mechanism for padlocks.

Historically padlocks using U shaped shackles have been found to be the most popular because of the ease and convenience of their attachment to and fit with the hasps and attachment devices with which they are used, to prevent the opening, unlatching, or coming apart of the secured elements.

The ubiquitous design, so popular for the last seventy or eighty years typically embodies a U shaped wire form that provides for the latching and locking of the shackle in the body of the padlock, and when unlocked and unlatched may be lifted so one end (the toe) is free of the body and may be pivoted around the retained end (the heel) providing sufficient clearance for the shackle to be readily engaged with the mechanism (hasp) to be secured. In the most common form this is a practical, reliable, and relatively economical solution to the problem of securing spaces or things. This idea is seen in U.S. Pat. Nos. 5,057 to Chambers (1847), 14,059 to Harrison (1856) and many others since. The utility of this concept replaced the previously popular swing style shackle seen in U.S. Pat. Nos. 1,243 to Nock (1839), 1,874 to Williams (1840) and numerous others including the overlapping swing shackle of U.S. Pat. No. 1,167,377 to Brown (1916). The lifting shackle of U.S. Pat. Nos. 18,169 to Yale (1857), or 418,359 to Troast (1889), the rotating shackle of U.S. Pat. No. 62,636 to Kelly (1867), or the shackleless padlock of U.S. Pat. No. 165,741 to Lockwood (1857), or the straight shackle of U.S. Pat. No. 438,824 to Price (1890), or the revolving shackle of U.S. Pat. No. 1,949,402 to Beaver (1934), all represent the continuing effort to achieve more effective protection by providing better, more secure padlock shackles. The intent of these early inventions continues today with clever devices to avoid the traditional shackle problems by hiding or eliminating the shackle as in U.S. Pat. Nos. 3,827,266 to Walters (1974), or 4,688,405 to Epstein (1987), or 4,689,975 to Dunphy et al (1987), each of which makes a contribution to improved security, but at high cost and with limited application, due to the restrictive fits inherent in the concepts.

The U shaped wire form shackle of constant circular cross section in common use today has several shortcomings that are difficult to overcome:

1. Many wire form shackles can be easily cut using commonly available tools. The traditional defense against this form of attack is to increase the diameter of the wire, with the consequent increase in the size of the lock body, or the choice of an alloy steel that can be hardened to make cutting more difficult. Each of these steps add significantly to the cost of the padlock. Another defense is the provision of a shield or shroud for the shackle to make access of cutting or forcing tools to the shackle and hasp staple difficult, but this defense is often costly and/or awkward to implement.

2. The latching mechanisms and shackles are often vulnerable to wedging, prying, and torsional attack because of the excessive space provided by the typical U shaped shackle and the sloppy fit with the hasp staple or attachment device which is often a characteristic of this arrangement.

3. The mechanical operation of lifting and pivoting the U shaped shackle is sometimes subject to malfunction caused by the environmental effects of corrosion or foreign matter (dirt and grit) within the close fitting assembly with the padlock body needed for security.

Accordingly, improvements in the design of padlocks using U-shaped shackles or other shackles to resolve the above and other shortcomings, even beyond those shortcomings solved by my U.S. Pat. No. 4,835,996 entitled "Tapered Shackle Padlock" and my U.S. Pat. No. 4,885,919 entitled "Sliding Shackle Padlock", is warranted. In addition my U.S. Pat. No. 5,146,771 entitled "Security Shield For Padlocks" and my U.S. Pat. No. 5,174,135 entitled "Tubular Hasp for Padlocks" provide alternative defenses for attacks against conventional U-shaped shackle padlocks, and my U.S. Pat. No. 4,431,220 entitled "Safety Release For Bar Lock" an emergency release for unconventional padlocks.

OBJECTS ADVANTAGES AND SUMMARY OF THE INVENTION

Accordingly, several objects and advantages of my invention are the use of a shackle incorporating a novel configuration that is easily and economically fabricated, difficult to cut or break and functionally reliable. This configuration provides increased protection to the hasp staple or attachment device by substantially filling the space available for the access of attack tools in at least one of the dimensions which define the space provided by the hasp staple or other attachment device. This concept and resulting novel configuration provides for a broad choice of materials and variety of manufacturing methods not previously available to the traditional U shaped wire form shackle. This novel arrangement provides for almost unlimited application and fit with the staples of hasps and attachment devices in popular use today.

Additionally, the present invention permits the exploitation of the following advantages:

(a) The choice of manufacturing methods such as simple stampings for forming the shackle elements, moldings, castings or others as might be appropriate to the material selected.

(b) The choice of a wide variety of materials for the shackle and padlock body elements optimized for the application and market.

(c) The choice of a wide variety of locking mechanisms, key cylinders, keyless devices, or security seals appropriate to the application and market.

(d) The choice of various configurations of hinge function, key location, and shackle fit to assure functional reliability, appropriate security, and user convenience with the hasp or attachment to be used.

One of the objects of this padlock concept is to provide the convenience of the popular U-shaped shackle padlock by the use of a novel two element tapered shackle arranged so that the elements together define an opening sufficient to accept the staple of the hasp or attachment device to be secured although the padlock need not be a U-shaped shackle padlock but can be one with any suitably shaped shackle and/or lock body. In the preferred embodiment, the two elements overlap one another. The shackle elements are preferably connected to a lock body at one end and when unlocked and unlatched are free to move apart, in any suitable motion, providing a clearance between them, at the unconnected end. Each shackle element includes an opening to allow the staple of the hasp to pass to the common opening defined by the shackle elements when together. This opening occurs in opposing elements so that when the elements are brought together or closed, the staple is completely enclosed by the two shackle elements. The elements are then latched and locked to provide the security function of a padlock engaged with the staple of a hasp or attachment device.

In another embodiment, a security device in the form of a wire can be provided whereby two overlapping security members include, in the preferred embodiment, a plurality of security apertures in which a plurality of secondary security seals can be provided. Preferably, each of the plurality of security seals includes indicia or locking means so that more than one individual is required to remove all of the security seals, thus enabling the hasp or other attachment device to be open by removal of the security device.

The above objects and advantages can be realized by using a padlock having a lock body, a first shackle element and a second shackle element associated with the lock body and moveable between an open position and a closed position and a lock associated with the lock body and at least one of the shackle elements for securing the shackle elements in the closed position and releasing the shackle elements from the closed position, whereby the shackle elements are sized and arranged so that when in the closed position in a hasp staple opening, the shackle elements substantially fill the hasp staple opening in at least one dimension so as to minimize access to the shackle elements and the hasp staple.

The filling of the hasp staple opening can be accomplished in any suitable manner, including sizing and arranging the shackle elements to overlay one another such that together they provide a thickness which is greater that the thickness of either of the shackle elements alone. Alternatively, one or both of the shackle elements can have a profile which is tapered in at least one dimension so that together or alone the shackle elements substantially fill the hasp staple opening in at least one dimension. Still further, one or both of the shackle elements can have tapered profiles such that alone or together the shackle elements substantially fill the hasp staple opening in the lateral dimension and the longitudinal dimension of the hasp staple opening. To facilitate insertion of the shackle elements into the hasp staple opening, the free ends of the shackle elements should be relatively small.

In a preferred embodiment, the shackle elements, in the closed position, together form a generally U-shaped shackle extending from the lock body so as to emulate conventional U-shaped shackle padlocks.

In another preferred embodiment, the shackle elements are straight, whereby one or both of the shackle elements are slideably moveable between an open position and a closed position. Where the shackle elements are straight, the lock body may be somewhat U-shaped in form to facilitate the use of the padlock in connection with a hasp device or other attachment device.

In another preferred embodiment, where the shackle elements form a generally U-shaped shackle extending from the lock body, at least one of the shackle elements is hinged so that the shackle elements are moveable away from one another in a direction transverse to the plane of the generally U-shaped shackle. In one preferred embodiment, the hinged shackle padlock provides for the hinging within the lock body. If desired, the hingeable movement of the hinged shackle elements can be prevented when the lock has secured the shackle elements in the closed position by a boss member, and at least one of the shackle elements must be moved in a direction away from the lock body in order to move the boss member so that it no longer prevents hingeable movement of the shackle elements. Preferably, the shackle elements are moveable in a direction which is parallel with the plane defined by the U-shaped shackle elements. Preferably, the boss member is carried by at least one of the shackle elements.

In yet another embodiment involving hinged shackle elements, the hingeable connection is by a hinge pin. In another hinge pin embodiment, the lock is at least partially disposed within the hinge.

In yet another hinge embodiment, the first and second shackle elements are hingeably connected by an integral hinge. This arrangement is particularly suitable for use of other materials and/or for padlocks which might be subject to adverse environmental conditions. In this integral hinge embodiment, the integral hinge can be prestressed so that the integral hinge normally maintains the shackle elements in the closed position. In the alternative, the integral hinge might be normally maintained in an open position. Preferably, the integral hinge is made of stamped metal.

In another embodiment, the shackle elements together form a generally U-shaped shackle, and at least one of the shackle elements is pivotally disposed within the lock body so that such shackle elements can be pivoted to move the shackle elements between the open and closed positions.

In another embodiment of the present invention, the shackle elements together form a generally U-shaped shackle and each are semicircular in shape, being disposed in the lock body so that at least one of the shackle elements rotates about a center of rotation in order to move the shackle elements between the open and closed position.

In another preferred embodiment, the shackle elements are swingable about a pivot point, which may be part of the lock body and/or hidden within the lock body, so that the shackle elements can swingably move between the open and closed positions. Again, as with any of the previous embodiments, the shackle elements may be made of stamped metal, and may include reinforcement structure in the form of layered stamped metal pieces, a shaped stamped metal piece or otherwise.

In yet another preferred embodiment where the shackle elements together form a generally U-shaped shackle extending from the lock body, the shackle elements are hingeably connected to or with the lock body, and a protective shield is slideably connected to the lock body between a secured position and a released position, whereby the shackle elements can only be moved between the closed position and the open position when the protective shield is in the released position.

In yet another preferred embodiment, the shackle elements are made of stamped metal, and each shackle element includes engaging structure for cooperative engagement of the first and second shackle elements when the shackle elements are in the closed position. The engagement structure may be a recess on one of the shackle elements and a toe on the other, or a hole on one of the shackle elements and a toe on another.

In yet another embodiment of the present invention, one of the shackle elements provides an opening in which the other shackle elements is inserted and disposed when the shackle elements are in the closed position. This arrangement can be constructed by stamped metal pieces, and can be an expedient from hiding the tip of one of the shackle elements, whether the shackle elements are liftable from the lock body in the conventional lift and pivot manner or swingable, pivotable or hingeable as set forth in previous embodiments.

In yet another embodiment of the present invention, the straight shackle elements have tips for insertion into the hasp staple opening and the shackle elements have tapered profiles from the tips towards the lock body such that the shackle elements substantially fill a hasp staple opening. Preferably, when the straight shackle elements are in the closed position, the free ends of the shackle elements are concealed within the lock body. More preferably, the straight shackle elements are securable in more than one closed position such that the shackle elements can be secured when they substantially fill a given hasp staple opening.

In another embodiment of the present invention, the shackle elements have free ends which are insertable into the hasp staple opening, and may be concealed within the lock body when the shackle elements are in the closed position.

In still a further embodiment of the present invention, a locking device can be provided which includes a lock body, first and second shackle elements associated with the lock body, the shackle elements being hingeably moveable towards and away from one another between an open position and a closed position and a lock body hasp projection which is associated with the shackle elements and provides an aperture through which a secondary security device can be inserted to prevent the shackle elements from being moved from the closed position to the open position. Preferably, the lock body has a portion which carries the first shackle element and a second portion which carries the second shackle element, at least one of the first and second portions having an opening through which said lock body hasp projection can extend at least when the shackle elements are in the closed position. The secondary security device intended for use in connection with this locking device can be a one-time use or temporary use device.

In another embodiment of the present invention, a security device is provided which includes a security element having a looped end for insertion into a hasp staple opening or attachment device and a security end at which at least one security seal can be provided, the security end including overlapping security members having aligned aperture for receiving a security seal or a plurality of aligned aperture for receiving a plurality of security seals. Preferably, the security members are in a normally closed position at which the loop portion of the security device cannot be removed from said hasp staple opening or attachment device, and are moveable from the normally closed position to an open position at which the wire can be inserted into or removed from the hasp staple opening or attachment device. The security seals used with the security device can be one-time use or temporary seals.

BRIEF DESCRIPTION OF THE FIGURES

FIG. 24A shows the shackles closed providing maximum cross-section as in FIG. 25, half-open as in FIG. 24B, with reduced cross-section FIG. 26, and fully open FIG. 24C.

FIG. 27A shows the shackles closed providing maximum cross-section as shown in FIG. 28, FIG. 27B shows the shackles half-open providing reduced cross section as shown in FIG. 29, and FIG. 27C shows the shackles fully open.

DETAILED DESCRIPTION OF THE PREFERRED EMBODIMENTS

Figure 2A:
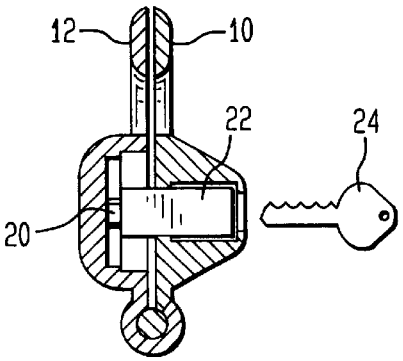
FIG. 2A shows a side view, in cut away, of the closed, latched and locked position of the padlock in FIG. 1.
Figure 2B:
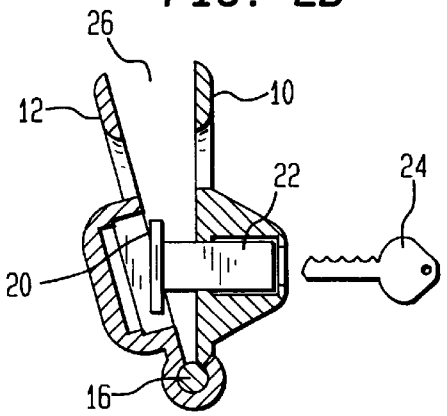
FIG. 2B shows a side view, in cut away, of the unlocked, unlatched and open position of the padlock in FIG. 1.
Figure 3:
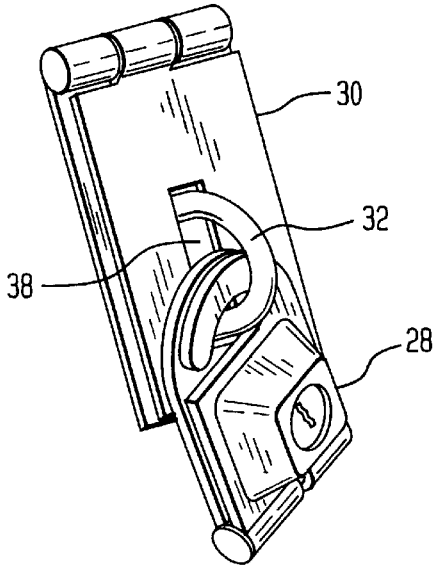
FIG. 3 shows a perspective view of the hinge shackle padlock in FIG. 1, as attached to a typical articulated hasp staple.
Figure 17:
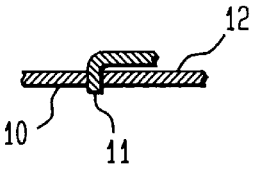
FIG. 17 shows a cross-section on line 17—17 in FIG. 16, illustrating in more detail the engagement between the shackle elements.
Figure 18:
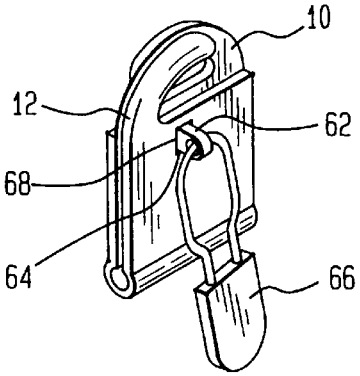
FIG. 18 shows a perspective view of a shackle padlock in accordance with a tenth embodiment of my invention, with a one-time or temporary use security seal providing the security function, and the shackle elements serving as a latch to keep a hasp or attachment device closed.
Figure 19:
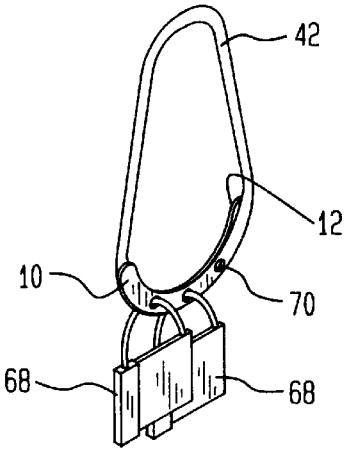
FIG. 19 shows a perspective view of a security device in accordance with an eleventh embodiment of my invention, showing a device made of a single wire form which incorporates several holes to accept multiple, one time or temporary use, security seals to provide a multiple control security function, the single wire form shackle elements serving as a latch to keep a hasp or attachment device closed.

Referring to the drawings wherein like referenced characters designate corresponding parts throughout the several figures, there is illustrated in FIGS. 1–17 a hinge shackle padlock embodying the present invention, and FIG. 3 illustrating a typical application. FIGS. 18 and 19 represent specialized applications of the concept embodying very simple structures utilizing one time use security seals as indicative security mechanisms. FIGS. 20–29 illustrate alternative embodiments of the two element split tapered shackle padlock in which various motions are employed to cause the shackle elements to separate for engagement with the staple of the hasp to be secured.

Figure 1:
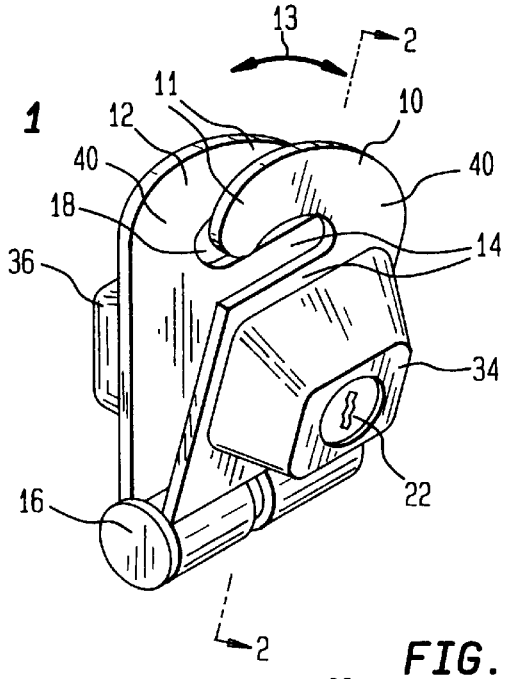
FIG. 1 shows a perspective view of a hinge shackle padlock in accordance with one embodiment of my invention, illustrating two shackle elements and a two piece lock body hingeably connected at one end, open at the other and a locking latch device to fasten the shackle elements together securely when closed.

A typical embodiment of the present invention in perspective view, unlocked, unlatched, and open is illustrated in FIG. 1. A first shackle element 10 and opposing second shackle element 12 are formed in the same shape composed of a small pointed tip 11 that increases in width to the widest section 40 to form the main part of a shackle 14. When arranged in opposition and connected with a hinge like device 16 with tip 11 of first shackle 10 in one direction and the tip 11 of second shackle 12 in the opposite direction this arrangement and the shape of the elements provide a common opening 18. The first shackle 10 and second shackle 12 include similar main elements 14 which provide a matching bottom for a common opening 18.

FIG. 2A illustrates the hinge shackle padlock in FIG. 1 in a cut away though section 2 showing in side view, closed, latched and locked. The first shackle 10 and second shackle 12 together result in essentially no space for hasp staple clearance 26 between the two shackle elements. A latch bolt 20 is in the latched position secured by a lock cylinder 22 in the locked position with a key 24 removed. This latch secures the two shackle elements 10 and 12 and prevents the padlock from opening. FIG. 2B illustrates the hinge shackle padlock from FIG. 1 in a cut away though section 2 shows in side view, the padlock in the unlocked, unlatched and open position by means of hinge motion 13 resulting in hasp staple clearance 26 between shackle elements 10 and 12. Hinge 16 permits the shackle elements 10 and 12 to open and close through motion 13 to cause hasp staple clearance 26. FIG. 3 illustrates a hinge shackle padlock 28 secured to a typical articulated hasp 30 by attachment to a hasp staple 32 with the tapered nature of first shackle 10 working in cooperation with a second shackle 12 to substantially fill the hasp staple opening 38 provided in a hasp staple 32 and allow minimal excess space for the hasp staple 32 in the common opening 18 permitted by the cooperation of shackle elements 10 and 12.

The operations and functions intended by the padlock in accordance with the present invention are achieved by providing a novel shackle comprised of two elements arranged so that they overlay each other to define an enclosed opening sufficient to accept the staple of a hasp or attachment device. The shackle elements 10 and 12 (FIG. 1) are connected at one end 16 and not connected at the other. The shackle elements 10 and 12 (FIG. 1) are shaped such that tips 11 are easily engaged with the intended staple 32 (FIG. 3) of hasp 30 or attachment device to be secured. The shackle elements 10 and 12 increase in size such that at their base, or maximum shackle cross section 40 they substantially fill opening 38 provided in the staple. When the two shackle elements are brought together or closed in an overlapping fashion the combined elements substantially fill opening 38 provided in the staple. The elements are fastened together and made secure with a latching bolt (or dead bolt) 20 (FIG. 2A) and when unlocked and unlatched are free to move apart, in a hinged motion 13 shown in FIG. 2B, providing a clearance 26 between the shackle elements, at the unconnected end. Each shackle element includes an opening 18 arranged at opposing ends to provide clearance for and the engagement of staple 32 (FIG. 3) of hasp 30 to be secured. This opening is such that when arranged in the closed position there is a common opening 18 to accept the staple of the hasp. This clearance opening occurs in the opposing elements so that when the elements are brought together or closed the staple is completely enclosed by the two shackle elements. The elements are then latched and locked to provide the security function of a padlock engaged with the staple of a hasp or attachment device. This novel arrangement provides a maximum cross section of shackle material to deter attack by cutting and prying tools. The non-circular shape and preferable substantially tight fit with the staple of the hasp reduces the opportunity of attack by cutting tools as well as prying, wedging or torsional tools. Even the minimization of any loose fit of the shackles in the hasp staple opening reduces the opportunity of attack. The hinge like function of the shackle operation results in a choice of a variety of latch mechanisms that reduce the weaknesses that are characteristic of the typical U shackle latch mechanisms.

The latch and lock mechanisms selected for use in the above and subsequent embodiments are not shown and could be chosen as appropriate to the application from mechanisms well knowing for use with padlocks.

Figure 4:
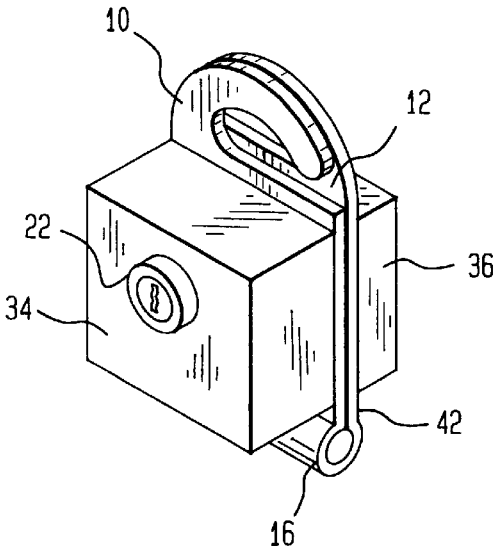
FIG. 4 shows a perspective view of a hinge shackle padlock in accordance with a second embodiment of my invention, in the locked position, having two shackle elements formed of a single unit to provide a hinge like function.

FIG. 4 shows another embodiment of a hinge shackle padlock utilizing a shackle formed of a continuous element 42 incorporating at the open end both first shackle 10 and second shackle 12 and having lock body portions 34 and 36 on either side. The construction of shackle element 42 is of metal or non-metal material selected for the appropriate spring like properties to assure ease of opening and closing of the shackle element at the continuous and integral hinge 16. The continuous nature of shackle element 42 avoids the problems resulting from environmentally-induced reliability concerns associated with conventional hinges and may afford lower manufacturing costs.

Figure 5:
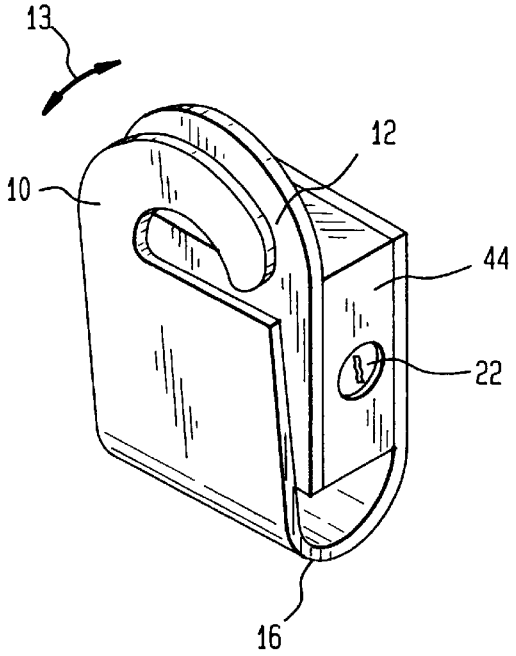
FIG. 5 shows a perspective view of a hinge shackle padlock in accordance with a third embodiment of my invention, in the open position, having one shackle formed to provide a hinge like function before joining with the body of the lock to which there is attached the second shackle element.

FIG. 5 shows an embodiment of the hinge shackle padlock similar to the continuous formed shackle element shown in FIG. 4 but incorporating a hinge 16 formed with a large radius to permit the use of stiff materials such as titanium to assure properties suited to the hinge function required with this application. Also, the lock body is essentially provided on one of the shackles.

Figure 6A:
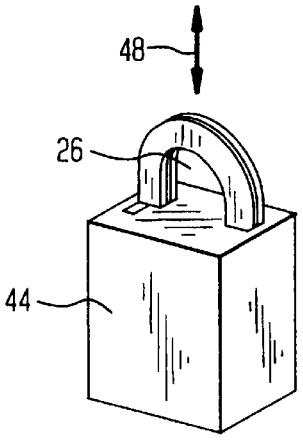
FIGS. 6A to 6C shows a perspective view of a hinge shackle padlock, in accordance with a fourth embodiment of my invention, having two shackle elements with protected tips secured within the protecting body (FIG. 6A), lifted from the protecting lock body (FIG. 6B), and then free to open with a hinge like motion (FIG. 6C).
Figure 6B:
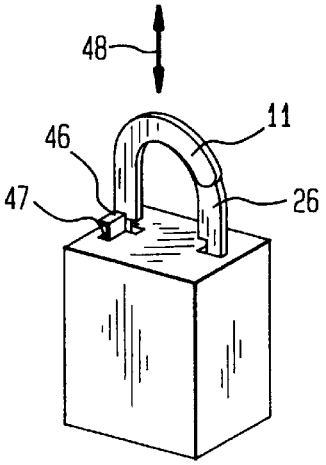
Figure 6C:
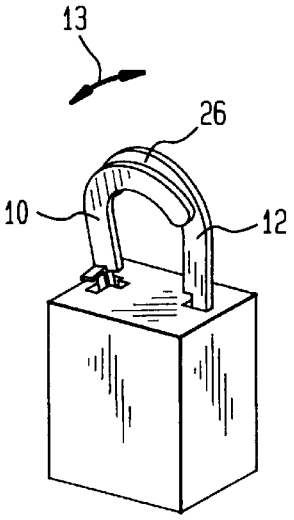

FIGS. 6A to 6C illustrate an embodiment which assures additional protection for tips 11 of shackle elements 10 and 12. Where the threat of a attack against shackle elements 10 and 12 is a security concern tips 11 may be secured within the protecting padlock body 44, as shown in FIG. 6A with the shackle elements closed and moved within padlock body 44. FIG. 6B shows the padlock unlocked, unlatched, and the two shackle elements 10 and 12 lifted along axis 48 sufficiently to provide hasp staple clearance 26 and guard 46 free of body 44. FIG. 6C shows shackle elements 10 and 12 hinged apart with motion 13 to provide hasp staple clearance 26 between the shackle elements. The example shown provides for shackle element 12 to lift clear of padlock body 44 sufficiently to provide hasp staple clearance 26 but to be limited to motion along 13. Shackle element 10 also lifts along axis 48 the same distance as shackle element 12 but is then free to hinge away from shackle element 12 in motion 13 sufficiently to provide hasp staple clearance 26 between element 10 and element 12. A guard 46 protects the opening 47 in padlock body 44 necessary to permit the hinge motion of element 10, described above, and assures the integrity of padlock body 44 when shackle elements 10 and 12 are in the closed, latched, and locked position shown in FIG. 6A.

Figure 7A:
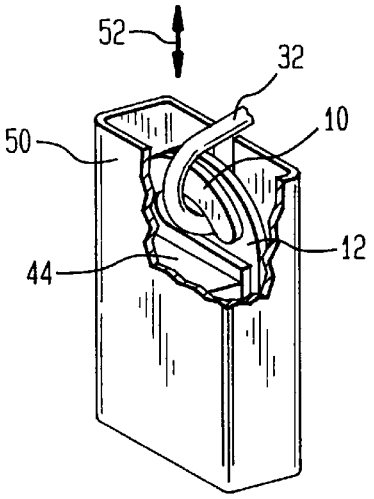
FIGS. 7A to 7C shows a perspective view of a hinge shackle padlock in accordance with a fifth embodiment of my invention, having two shackle elements closed and engaged with the staple of a hasp and protected by a sliding shield (FIG. 7A), shield moved clear of the closed shackle elements (FIG. 7B), and shackle elements hinged open (FIG. 7C).
Figure 7B:
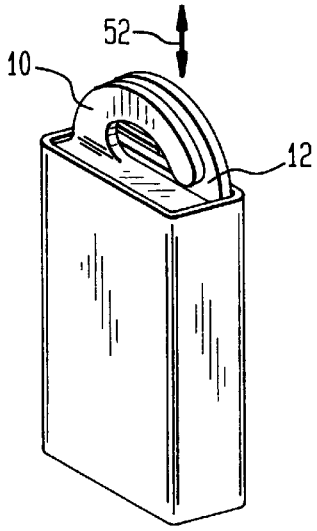
Figure 7C:
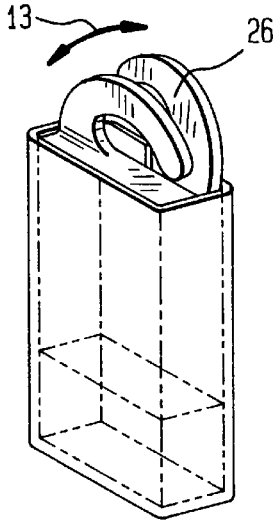

FIGS. 7A to 7C illustrates another embodiment to provide additional protection of the two shackle elements 10 and 12 and the hasp staple 32 by means of a sliceable shield 50 which moves along axis 52 to latch and lock as shown in FIG. 7A. The shield is attached to the lock body in any suitable manor so that when it is unlocked and unlatched, it may move along axis longitudinal 52 to clear shackle elements 10 and 12 shown in FIG. 7B, which are then free to hinge open in motion 13 to provide hasp staple clearance 26 FIG. 7C.

Figure 8:
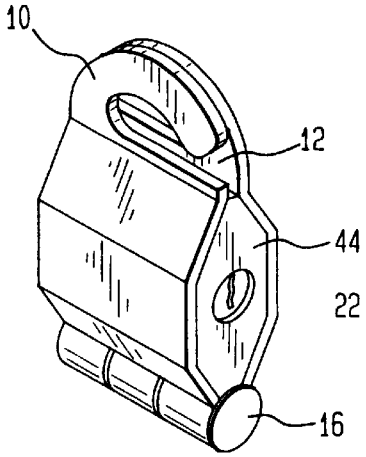
FIG. 8 shows a perspective view of a hinge shackle padlock in accordance with a sixth embodiment of my invention, with the lock body and mechanism protected between the shackle elements.

The concept embodied in the hinge shackle padlock permits many variations in design details to accommodate to various needs of the market place. FIG. 8 shows an embodiment which allows the padlock body 44 and lock cylinder 22 to be protected by the structure of shackle elements 10 and 12.

Figure 9:
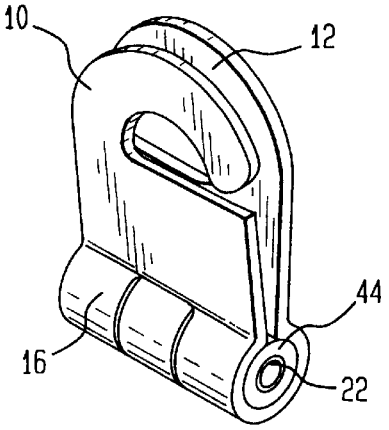
FIG. 9 shows a perspective view of a hinge shackle padlock in accordance with a seventh embodiment of my invention, with the lock cylinder arranged in a coaxial fashion with the hinge mechanism connecting the shackle elements.

FIG. 9 shows an embodiment similar to that in FIG. 8, but with the lock cylinder 22 arranged in a coaxial fashion with the hinge 16 to protect the lock an latch mechanism.

Figure 10:
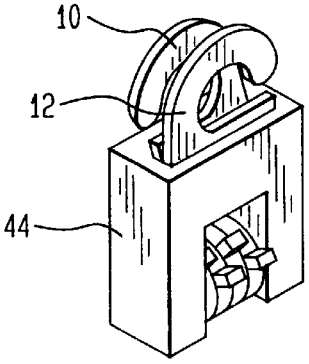
FIG. 10 shows a perspective view of a hinge shackle padlock in accordance with an eighth embodiment of my invention, with a keyless, combination function, locking mechanism.

Keyless padlocks are popular for many applications and various mechanisms exist to provide a combination lock function. FIG. 10 shows an embodiment comprising a typical wheel combination mechanism integrated with a lift to open style hinge shackle padlock similar to that illustrated in FIGS. 6A to 6C. The details of the well known locking and latching mechanisms and hinge are not shown.

Figure 11:
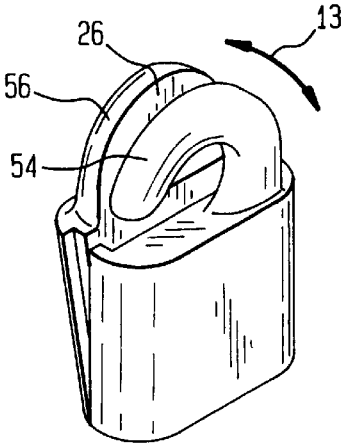
FIG. 11 shows a perspective view of a hinge shackle padlock in accordance with a ninth embodiment of my invention, where the shackle elements are fabricated as integral parts of the lock body (cylinder) and lock body (latch) components.

The need for massive and hard to attack padlock shackles utilizing materials selected to optimize resistance to cutting and forced attack is shown in the embodiment FIG. 11. An integral shackle element and lock body (cylinder) 54 and a shackle element and lock body (latch) 56 provide such a massive structure. This arrangement permits integral element 54 and integral element 56 to be connected with a hinge 16 (not shown) allowing sufficient motion 13 to allow hasp staple clearance 26 when in the unlocked, unlatched, and open position illustrated in FIG. 11.

Figure 12:
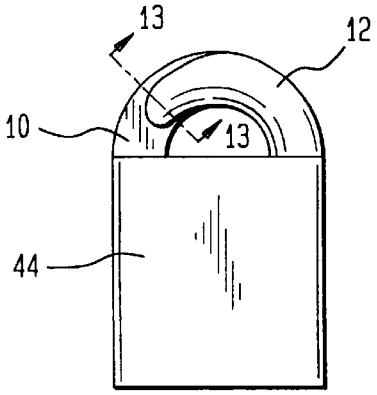
FIG. 12 shows an elevation view of a hinge shackle padlock, typical of all embodiments in accordance with my invention, having two shackle elements.
Figure 13A:
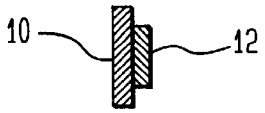
FIGS. 13A to 13D show alternate cross-sections on line 13—13 in FIG. 12, showing different expedients for stiffening the shackle elements, some of stamped metal, to resist forcing attack, by, for example, the selection of material, (FIG. 13A), by a formed shape for reinforcement, (FIG. 13B), by multiple layer laminations, (FIG. 13C), or by a fabricated stiffened shape, (FIG. 13D).
Figure 13B:
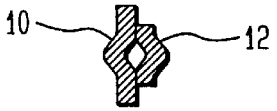
Figure 13C:
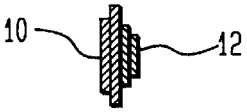
Figure 13D:
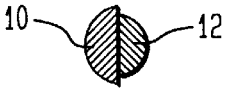

The several embodiments of the hinge shackle padlocks in accordance with my invention described above invite new methods of forced attack not previously appropriate or needed to attack the padlock shackles found in the prior art. FIG. 12 shows in plan view a typical hinge shackle padlock. FIGS. 13A to 13D show in cross-section several methods of stiffening the shackle elements to deter forced attack, FIG. 13A shows in cross-section that the dimensions of, and materials chosen for the shackle elements 10 and 12 determine the stiffness of the elements. FIG. 13B shows in cross-section that the shackle elements 10 and 12 may be formed to increase their resistance to bending. FIG. 13C shows in cross-section that shackle elements 10 and 12 may be fabricated of multiple layers or laminations to increase their resistance to bending. FIG. 13D shows in cross-section that shackle elements 10 and 12 may be fabricated as machined, molded or cast parts to provide a shape intended to resist bending and provide stiffness to resist forced attack.

Figure 15:
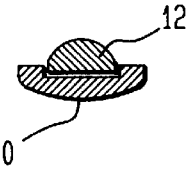
FIG. 15 shows a cross-section on line 15—15 in FIG. 14, illustrating in more detail the engagement between the shackle elements.
Figure 14:
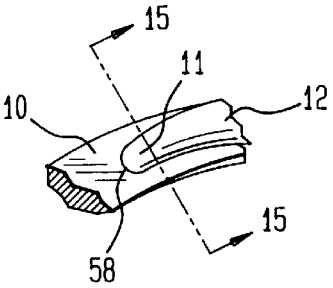
FIG. 14 shows a perspective view of a portion of shackle elements of a shackle padlock in accordance with yet another embodiment of my invention, where the main portion of the first shackle element and cooperating tip of the second shackle element are in engagement with a recess formed in the first shackle element to protect the shackle element from forced attack.

FIG. 14 shows in perspective view a section of shackle elements 10 and 12 where shackle element 10 is provided with a recess 58 to accept to accept toe 11 of shackle element 12 to protect the shackle elements from a prying attack. FIG. 15 shows in cross-section toe 11 of shackle element 12 in recess 58 provided in shackle element 10.

Figure 16:
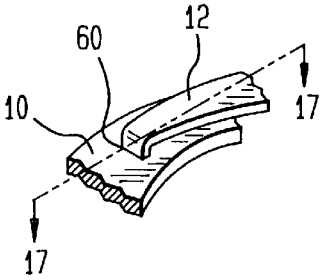
FIG. 16 shows a perspective view of a portion of shackle elements in accordance with yet another embodiment of my invention, showing another means to engage and protect the cooperating shackle elements of the hinge shackle padlock.

FIG. 16 shows in perspective view a section of shackle elements 10 and 12 where shackle element 10 is provided with a hole 60 to accept toe 11 of shackle element 12 formed to engage hole 60 to protect the shackle elements from prying attack. FIG. 17 shows in cross-section the toe 11 of shackle element 12 engaged in the hole 60 provided in shackle element 10.

In the embodiments in FIGS. 1 to 17, the shackle elements can be spring loaded so that the elements automatically move into the desired position, as appropriate for the application.

Other security requirements are often met by the use of indicative, one-time or temporary use devices such as security seals. FIG. 18 shows a hinge shackle padlock with shackle elements 10 and 12 included as parts of a continuously formed shackle element 42. This embodiment includes a Latch tab 62 which is part of shackle element 12 and includes a seal hole 64 to accept security seal 66. Tab 60 passes through tab hole 68 in shackle element 10 to close the hinge shackle padlock. The hinge shackle padlock is made secure by attaching seal 66 through hole 64 to prevent the hinge shackle padlock from being opened. This embodiment contemplates an application where shackle elements 10 and 12 assure sufficient structure to function as a latch to keep a hasp engaged with a hasp staple or the elements of an attachment device connected and where indicative, one time use, security devices such as seals are more appropriate that traditional key function padlocks.

FIG. 19 shows an additional embodiment where continuously formed shackle element 42 includes multiple matching holes 70 in opposing shackle elements 10 and 12 to accept several independent security seals 66. This embodiment contemplates applications where multiple authorities control access to a hasp or attachment device and where an indicative, one time use, security seal is more appropriate that a key function padlock.

There are alternative embodiments incorporating the principals of two tapered shackle elements of the hinge shackle padlock in accordance with my invention where a motion other than a hinge motion results in the separation of the shackle elements to permit the engagement of the shackle elements with the staple of a hasp or attachment device to be secured.

Figure 20:
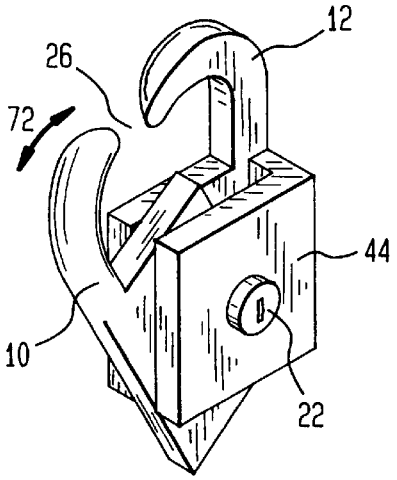
FIG. 20 shows a perspective view of shackle padlock in accordance with a twelfth embodiment of my invention, illustrating two shackle elements connected at one end and free to swing apart in the same plane, and a latching and locking device to fasten the shackle elements together securely when in the closed position.

FIG. 20 shows in perspective view a swing shackle padlock embodiment where the shackle elements 10 and 12 move apart in a swinging motion 72 in the same plane to open a staple clearance 26. The functions of lock body 44 and lock cylinder 22 remain unchanged.

Figure 21B:
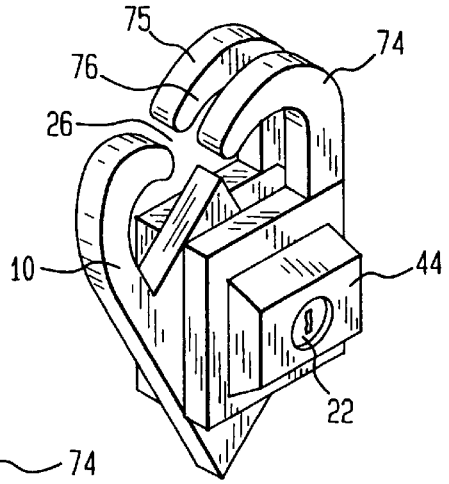
FIGS. 21A and 21B show perspective views of a swing shackle padlock representing a thirteenth embodiment in accordance with my invention, having the first shackle element comprised of two parts and having a slot to accept the second single shackle element between the two parts of the first for protection against forced attack when in the closed position as shown in FIG. 21A, and in the open position as shown in FIG. 21B.
Figure 21A:
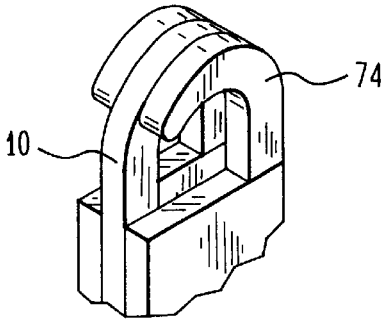

FIGS. 21A and 21B show a swing shackle padlock with a shackle element comprising two matching parts, a front part 74 and a rear part 75 separated by a space 76 to accept shackle element 10 in the closed and protected position FIG. 21A, and open position FIG. 21B.

Figure 22A:
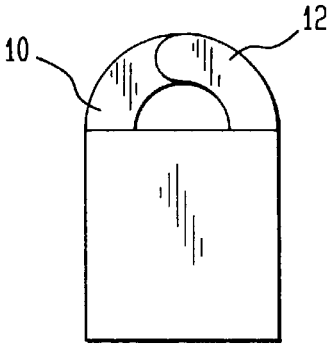
FIG. 22A and FIG. 22B show in elevation views a lift shackle padlock representing a fourteenth embodiment in accordance with my invention, having two shackle elements arranged to engage the first element between the two parts of the second element in the closed position (FIG. 22A), and with the first shackle element lifted clear of the second shackle element (FIG. 22B).
Figure 22B:
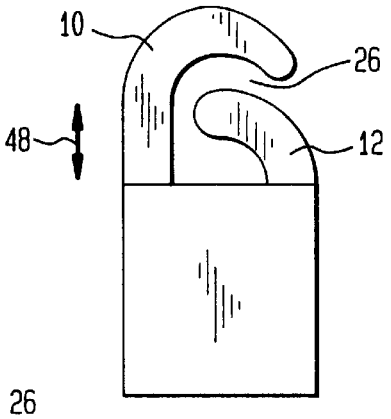
Figure 22C:
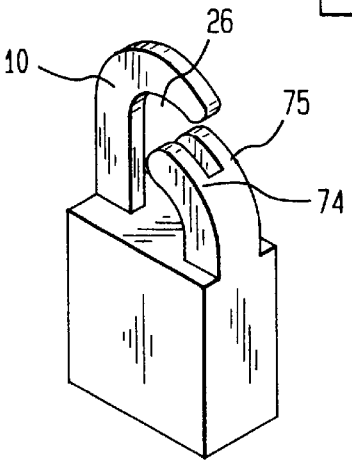
FIG. 22C shows in perspective view the lift shackle padlock in FIGS. 22A and 22B, showing the padlock in the open position.

FIGS. 22A to 22B show in plan view a lift shackle padlock embodiment where shackle elements 10 and 12 are closed FIG. 22A and open with shackle element 10 moved in a lifting motion 48 a sufficient distance to provide hasp staple clearance 26 FIG. 22B. FIG. 22C is a perspective view of the lift shackle padlock showing a two part protected shackle elements 74 and 75 with shackle element 10 in the lifted open position FIG. 22C.

The currently popular U shackle padlock, rotating shackle padlock, and straight shackle padlock may also be improved in their versatility and security in certain applications by incorporation of the principle of the two element split tapered shackles in accordance with my invention using other than the hinge, swing or lift motion described above.

Figure 23A:
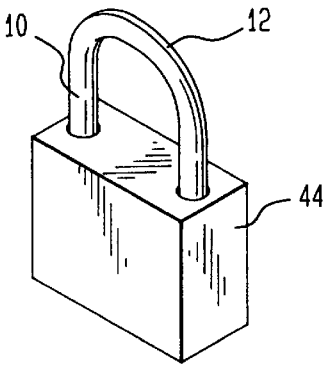
FIGS. 23A to 23C show perspective views of a lift and pivot shackle padlock representing a fifteenth embodiment in accordance with my invention, having two split tapered shackle elements functioning in the lift and pivot style, the two elements being closed in the padlock body in FIG. 23A, lifted together in FIG. 23B, and pivoted open in FIG. 23C.
Figure 23B:
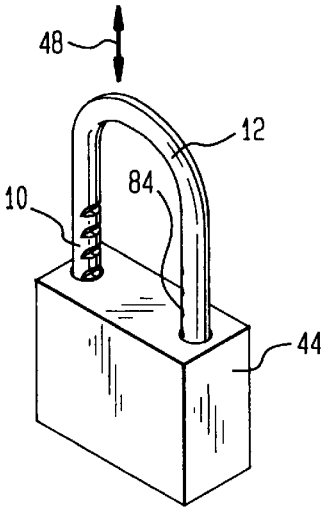
Figure 23C:
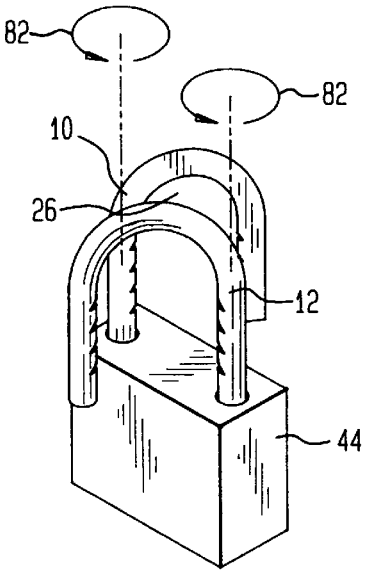

FIGS. 23A to 23C show in perspective view an embodiment having two split tapered lift and pivot shackle elements 10 and 12 closed latched and locked FIG. 23A. unlocked, unlatched from multiple latch or ratchet points 84, and lifted along axis 48 from the padlock body 44 FIG. 23B, and pivoted, 82 open to provide hasp staple clearance 26, FIG. 23C.

Figure 24A:
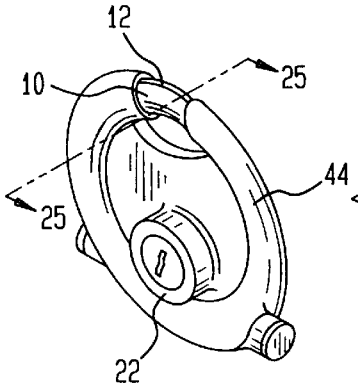
FIGS. 24A to 24C show perspective views of a padlock representing a sixteenth embodiment in accordance with my invention, having two split tapered shackle elements working in cooperation and rotating in opposing directions.
Figure 24B:
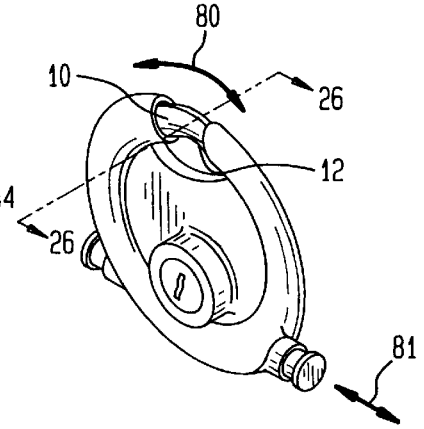
Figure 24C:
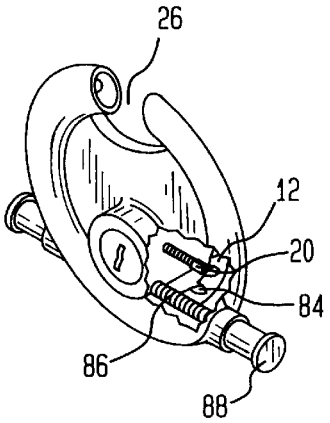
Figure 25:
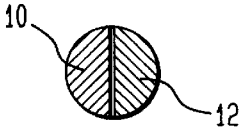
Figure 26:
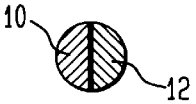

FIG. 24A shows in perspective view another embodiment having two split tapered rotating shackle elements 10 and 12 closed, latched, and locked with maximum shackle cross-section FIG. 25. FIG. 24B shows in perspective view the same embodiment with shackle elements 10 and 12 rotated in opposing directions 80 induced by lateral motion 81, and due to their tapered shape providing a reduced cross-section FIG. 26 when latched and locked at an intermediate position required for fit with the hasp or attachment device in a specific application. FIG. 24C shows in perspective view this padlock in the fully open position with hasp staple clearance 26 available for attachment to a hasp or attachment device, and cutaway showing flexible shackle coupling 86 of shackle element 10 and shackle extension 88. Also shown are multiple latch points or ratchet 84, and latch bolt 20 working in cooperation with shackle element 12 to latch and lock the shackle elements 10 an 12 in the appropriate position.

Figure 27A:
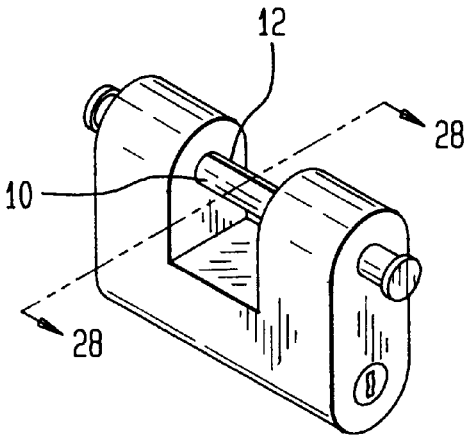
FIGS. 27A to 27C show perspective views and FIGS. 28 and 29 show cross-sectional views a padlock representing a seventeenth embodiment in accordance with my invention having two split tapered shackle elements working in cooperation and sliding in opposing directions.
Figure 27B:
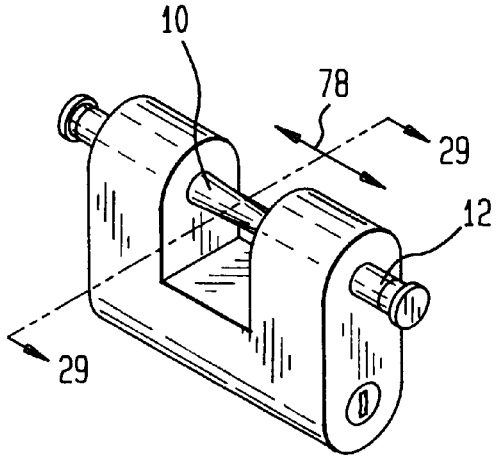
Figure 27C:
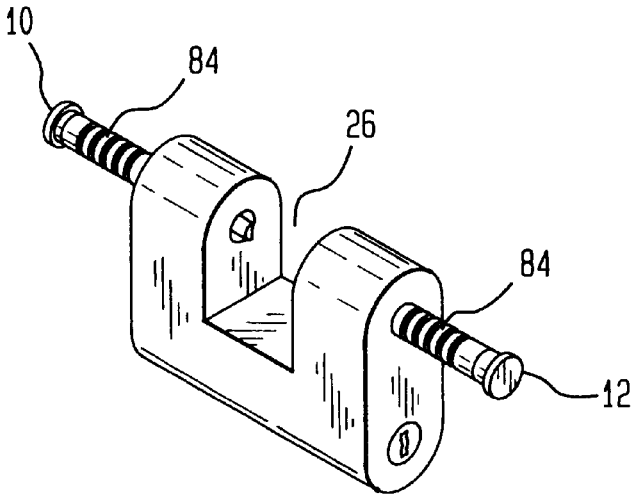
Figure 28:
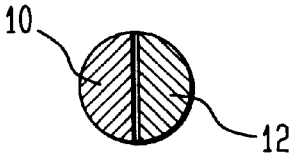
Figure 29:
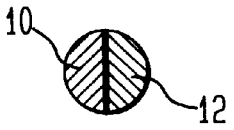

FIG. 27A shows in perspective view an other embodiment having two split tapered straight shackle elements 10 and 12 closed, latched and locked with maximum shackle cross-section FIG. 28. FIG. 27B shows the same embodiment with shackle elements 10 and 12 slid in opposing directions 78 and due to their tapered shapes providing a reduced cross-section FIG. 29 when latched and locked at an intermediate position required for fit with the hasp staple or attachment device used in a specific application. FIG. 27C shows this padlock in the fully open position revealing multiple latch points or ratchet 84 with hasp staple clearance 26 available to accept the hasp staple or attachment device.

Accordingly, the reader will see that this hinge shackle padlock concept provides the opportunity for improved security at reduced cost at the various levels of security required by the needs of the market. The novel shackle construction allows for the use of new materials not now suited to conventional U shaped shackles.

The hinge like motion required to open or separate the overlapping shackle elements 10 and 12 does not involve close tolerance fits and thus avoids the sources of malfunction due to environmentally induced corrosion or foreign matter frequently incurred with typical U shackle padlocks.

The shackle elements may be fabricated of flat metal material, stamped and formed as appropriate to the selected design, cost objectives, and application needs. This could be steel, alloy steel, brass, titanium, or whatever meets the design or application criteria. This concept also invites the use of cast or powdered metal elements or the newer polymer materials such as the General Electric Co's Xenoy 6620 "TN", or cross ply fiber-resin composites such as Kevlar reinforced polysalazene, which may provide extraordinary physical properties but are not suited to the structural elements found in U shackle padlocks.

The versatility of the concept allows a full spectrum of designs from minimal cost derivatives using simple warded lock mechanisms providing minimal security to combination, keyless mechanisms, to rotary disc cylinders such as U.S. Pat. Nos. 4,982,586 to Wingert (1991) or 4,195,503 to Roberts (1980) for environmental reliability including the use of appropriate materials, to the most sophisticated high security mechanisms an materials. Devices using one time use indicative security seals such as U.S. Pat. No. 4,353,583 to Moberg (1982) or even U.S. Pat. No. 4,095,872 to Steiff et al (1978) may be incorporated as the security or locking element in certain suitable applications.

This invention provides the look, feel, and protection of a massive shackle padlock at low cost to the typical domestic consumer of inexpensive padlocks. The hinged shackle padlock design can be optimized to fit and secure the staple of the most common articulated hasps in use today. The shackle concept described above is intended to substantially fill the space provided by the staple. The resulting snug fitting combination of shackle and staple are difficult to attack when compared to the loose fitting arrangement that results from the combination of a U shackle padlock and the staple of the traditional hasp.

While my above description contains many specificities, these should not be construed as limitations on the scope of the invention, but rather as an exemplification of several preferred embodiments thereof. Many other variations are possible. Accordingly, the scope of the invention should be determined not by the embodiments illustrated, but by the appended claims and their legal equivalents.

I claim:

1. A security device for use with a hasp device having a hasp staple opening, said security device comprising:

a first shackle element including a front planar surface and a back and a second shackle element including a front planar surface and a back, each of said shackle elements being configured to have a hook-shaped free end, an intermediate body portion and a second end distal from said free end, said second ends each having a length, at least one of said first and second shackle elements being moveable with respect to one another between an open position at which said front planar surfaces lie askew relative to one another creating a space between said front planar surfaces which is adapted to allow the free ends to be inserted into or removed from the hasp staple opening of the hasp device and a closed position at which said front planar surfaces lie relative to one another to substantially eliminate said space between said front planar surfaces; in said closed position, the free end and the body portion of said front planar surface of said first shackle element overlie a portion of the free end and the body portion of said front planar surface of said second shackle element, said first and second shackle elements being connected to one another along a hinge axis which extends substantially the entire length of said second ends, said first and second shackle elements being moveable such that said first and second shackle elements are rotated from said closed position to said open position only by rotating at least one of said front planar surfaces of said shackle elements about said hinge axis in an opening direction which is away from said front planar surface of the other shackle element, there being no movement of said at least one shackle element in any other direction other than said opening direction when at least one said shackle element is moved from said closed position to said open position; and a security seal associated with both of said first and second shackle elements for selectively securing said first and second shackle elements in said closed position to thereby prevent movement of said shackle elements, wherein one of said intermediate body portions carries a hasp projection and the other of said intermediate body portions includes an opening through which said hasp protection extends at least when said shackle elements are in said closed position such that said security seal can be inserted through said hasp projection to thereby prevent movement of such shackle elements away from one another.

2. The security device in claim 1, wherein said security seal is a one-time use seal.

3. The security device is claim 1, wherein each of said free ends of said shackle elements is at least partially tapered in at least one dimension.

* * * * *

UNITED STATES PATENT AND TRADEMARK OFFICE

CERTIFICATE OF CORRECTION

PATENT NO. : 5,934,113

DATED : August 10, 1999

INVENTOR(S) : Robert W. Loughlin

It is certified that error appears in the above-identified patent and that said Letters Patent is hereby corrected as shown below:

Column 2, line 22, after "OBJECTS" insert --,--

Column 8, line 42, "with a second shackle" should read --with second shackle--.

Column 9, line 25, "knowing" should read --known--.

Column 11, line 10, "Latch" should read --latch--.

Column 12, line 60, "mechanisms an materials" should read --mechanisms and materials--.

Column 14, line 33, "device is claim 1." should read --device in claim 1.--.

Signed and Sealed this

Fourteenth Day of March, 2000

*Attest:*

Q. TODD DICKINSON

*Attesting Officer*

*Commissioner of Patents and Trademarks*